US009872094B2

(12) United States Patent
Meyer et al.

(10) Patent No.: US 9,872,094 B2
(45) Date of Patent: Jan. 16, 2018

(54) SPEAKER COUPLING AND BRACKET

(71) Applicant: Apple Inc., Cupertino, CA (US)

(72) Inventors: Robert F. Meyer, Palo Alto, CA (US); Daniel W. Jarvis, Sunnyvale, CA (US); Richard Hung Minh Dinh, Santa Clara, CA (US); Stoyan Hristov, San Jose, CA (US)

(73) Assignee: Apple Inc., Cupertino, CA (US)

( * ) Notice: Subject to any disclaimer, the term of this patent is extended or adjusted under 35 U.S.C. 154(b) by 32 days.

(21) Appl. No.: 14/975,508

(22) Filed: Dec. 18, 2015

(65) Prior Publication Data

US 2017/0070795 A1 Mar. 9, 2017

Related U.S. Application Data

(60) Provisional application No. 62/214,797, filed on Sep. 4, 2015.

(51) Int. Cl.
*H04R 1/02* (2006.01)

(52) U.S. Cl.
CPC ..... *H04R 1/023* (2013.01); *H04R 2499/11* (2013.01)

(58) Field of Classification Search
CPC . H04R 1/00; H04R 1/02; H04R 1/021; H04R 1/026; H04R 1/04; H04R 1/08; H04R 2499/11; H04R 25/604; H04R 1/1075; H04R 21/023
See application file for complete search history.

(56) References Cited

U.S. PATENT DOCUMENTS

2009/0245565 A1* 10/2009 Mittleman ..... H04M 1/035 381/365
2011/0172001 A1* 7/2011 Schoerkmaier ..... H04M 1/035 455/575.1
2015/0195631 A1* 7/2015 Forrester ..... H04M 1/03 381/345
2016/0073194 A1* 3/2016 Auclair ..... G10K 11/18 381/345
2016/0302000 A1* 10/2016 Shin ..... H04R 1/1083

* cited by examiner

*Primary Examiner* — Thang Tran
(74) *Attorney, Agent, or Firm* — Kilpatrick Townsend & Stockton LLP

(57) ABSTRACT

This application relates to an audio assembly that includes both a speaker assembly and a microphone. By mounting both the microphone and the speaker assembly to a unitary audio bracket, space savings can be achieved over a configuration that relies on separate brackets for each component. In some embodiments, an acoustic mesh can be embedded within the audio bracket and extending across an audio channel defined by the audio bracket. The microphone can be aligned with an opening in the audio bracket by an alignment clip that is coupled with the microphone. The alignment clip helps to achieve alignment of a sensor opening of the microphone with a channel defined by the audio bracket.

14 Claims, 8 Drawing Sheets

*B-B*

SPEAKER COUPLING AND BRACKET

CROSS REFERENCE TO RELATED APPLICATIONS

This application claims priority under 35 USC 119(e) to U.S. Provisional Patent Application No. 62/214,797 filed on Sep. 4, 2015, and entitled "SPEAKER COUPLING AND BRACKET," the disclosure of which is incorporated by reference in its entirety and for all purposes.

FIELD

The described embodiments relate generally to the efficient integration of audio components within an electronic device. In particular, a bracket for guiding audio into and out of the electronic device is described herein.

BACKGROUND

In an effort to progressively reduce the size of and concurrently improve the functionality of a portable electronic device, novel ways of optimizing space within the portable electronic device become increasingly important. Increased and improved functionality often come in the form of additional components and/or sensors. The additional components or sensors tend to take up space in a device housing of the portable electronic device that may not be available. While reducing a size of other components can help to produce additional space, such methods can unfortunately result in reduced functionality or performance. Consequently, additional methods for optimizing space within the device housing are desired.

SUMMARY

This disclosure describes various embodiments that relate to ways for securing a speaker assembly and a microphone assembly within a device housing.

An audio bracket is disclosed. The audio bracket is suitable for conducting audio between audio components and audio openings defined by a housing of a portable media device. The audio bracket can include at least the following: a polymeric substrate defining an audio channel therethrough; and an acoustic mesh embedded within the polymeric substrate and extending across the audio channel, the acoustic mesh preventing particulates from passing through the audio channel.

A portable media device is disclosed and can include the following: a device housing including a wall defining multiple audio openings; an audio bracket including a first end and a second end opposite the first end, the audio bracket defining multiple audio channels extending from the first end to the second ends of the audio bracket, the first end being coupled with a portion of the wall that defines the audio openings; a speaker housing defining an opening configured to emit audio and including a laterally protruding arm. A portion of the speaker housing defining the opening is coupled with the second end of the audio bracket so that audio emitted by the speaker housing is transmitted through one of the audio channels and then out of the device housing by one of the audio openings. The audio bracket also includes a microphone coupled with the laterally protruding arm and the second end of the audio bracket, the microphone being positioned to receive audio entering the device housing through one of the audio openings by way of one of the audio channels.

An audio assembly is disclosed and can include the following: a speaker assembly, comprising a speaker housing that includes a laterally protruding arm; a microphone coupled with the laterally protruding arm; an audio bracket defining multiple audio channels through which the microphone receives audio and the speaker assembly transmits audio. The audio bracket is coupled with both the microphone and the speaker assembly.

BRIEF DESCRIPTION OF THE DRAWINGS

The disclosure will be readily understood by the following detailed description in conjunction with the accompanying drawings, wherein like reference numerals designate like structural elements, and in which.

Figure 1:
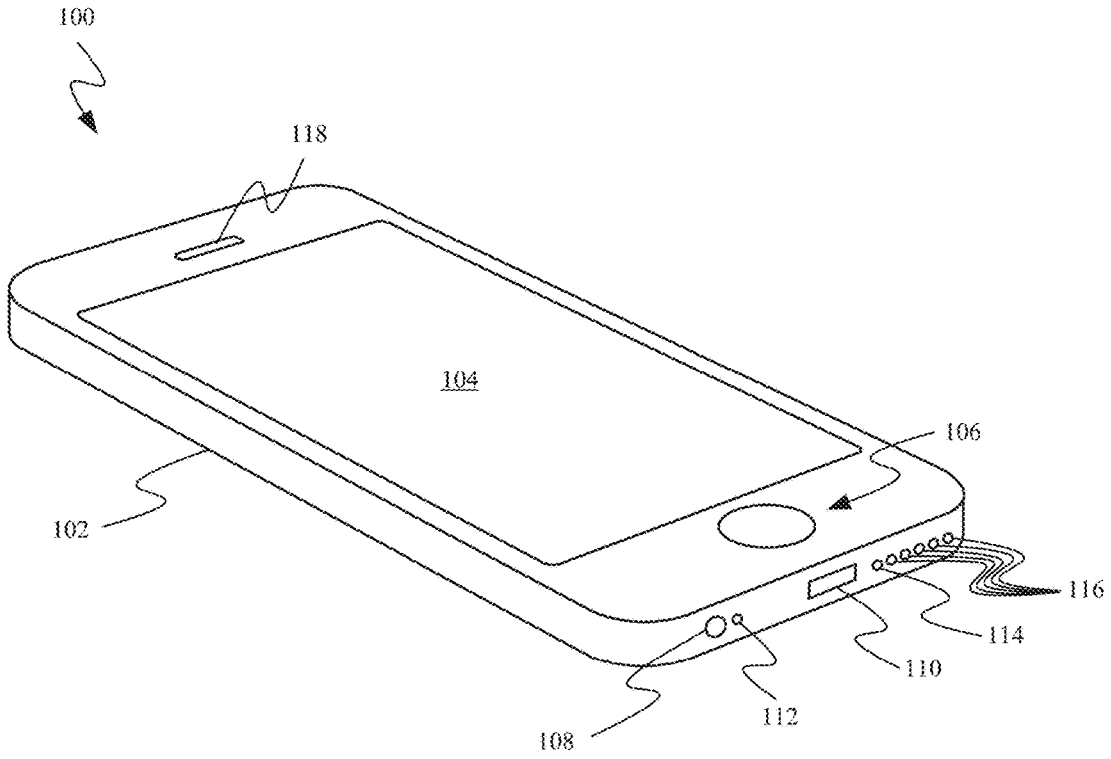
FIG. 1 shows an exemplary device suitable for use with the described embodiments.

Other aspects and advantages of the invention will become apparent from the following detailed description taken in conjunction with the accompanying drawings which illustrate, by way of example, the principles of the described embodiments.

DETAILED DESCRIPTION

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Modern portable media devices are capable of carrying out a wide variety of functions. To accomplish these varied functions, many cutting edge components and sensors are packaged into a portable media device. While developing the portable media device with numerous discrete off the shelf components can result in a lower development cost, packaging these components together can be challenging and often result in many inefficiencies that cause the portable media device to be much larger than desired. One solution to this problem is to combine one or more components together so that the combined components can share common electrical and/or structural features, thereby saving space by reducing the number of redundant parts.

One function common to many portable media devices is the ability to provide a two-way link over which a conversation between at least two people can be conducted. At minimum, the portable media device includes both a speaker and a microphone so that each person can be both heard and listen during the conversation. While a conversation can be carried on with just one microphone, often times equipping the portable media device with multiple microphones can help to improve the voice quality and/or increase the number of orientations in which the device can be held while maintaining the capability to receive and transmit high quality audio. Unfortunately, both microphones and speakers often need to be positioned by an opening that allows audio to pass into and out of a device housing of the portable media device. Microphones and speakers also generally need to be oriented in a way that optimizes transmission of the audio. Orientation of these devices in this way can require various mounting hardware that can take up a substantial amount of space within the portable media device.

One way to reduce an amount of space taken up within the portable media device is to use a single piece of mounting hardware to secure multiple audio devices. In some embodiments, both a microphone and a speaker can be coupled within an interior surface of a device housing of the portable media device by a unitary audio bracket. The unitary audio bracket can include discrete openings for transmitting audio between each of the audio devices and the exterior environment. In some embodiments, the audio bracket can include mechanisms for preventing undesirable particulates from entering the portable media device by way of the numerous audio ports. In some embodiments, an acoustic mesh can be embedded within the audio bracket, thereby saving space that would otherwise be taken up by a discrete audio mesh assembly. The acoustic mesh can be embedded within the audio bracket during an insert molding operation, during which molten polymeric material solidifies, causing peripheral portions of the acoustic mesh to be embedded within a polymeric substrate. Although this description describes numerous cases in which the audio bracket takes the form of a polymeric substrate, it should be noted that any material suitable for use during an injection molding operation is possible and deemed to be within the scope of this description.

These and other embodiments are discussed below with reference to FIGS. 1-7; however, those skilled in the art will readily appreciate that the detailed description given herein with respect to these figures is for explanatory purposes only and should not be construed as limiting.

FIG. 1 shows a portable media device 100 suitable for use with embodiments disclosed herein. Portable media device 100 can include a device housing 102 configured to protect various electrical components and sensors of portable media device 100. Portable media device 100 can also include touch sensitive display 104 configured to provide a touch sensitive user interface for controlling portable media device 100. A protective cover associated with touch sensitive display 104 can also cooperate with device housing 102 to substantially enclose operational and structural components of portable media device 100. In some embodiments, portable media device 100 can include additional controls such as, for example, button 106. Multiple hard-wired input/output (I/O) ports that include analog I/O port 108 and digital I/O port 110. Audio devices within device housing 102 can receive and transmit audio by way of audio openings. For example, audio opening 112 can be defined by device housing 102 and configured to allow audio to enter portable media device 100 and be detected by a microphone positioned within device housing 102. In some embodiments, audio opening 114 can also be associated with a microphone. A spatial interval between microphones associated with audio openings 112 and 114 can be used to perform a certain amount of beam forming that can filter unwanted audio out of the audio received by the two microphones. Device housing 102 also defines multiple audio opening 116, which can be associated with a speaker along the lines of a speaker phone suitable for allowing a user to monitor an audio conversation without having the user's ear positioned directly against portable media device 100 at speaker opening 118. Portable media device 100 can include numerous other operational components, such as for example, a processor, one or more wireless transceivers, a non-transitory computer readable memory device and a battery.

Figure 2:
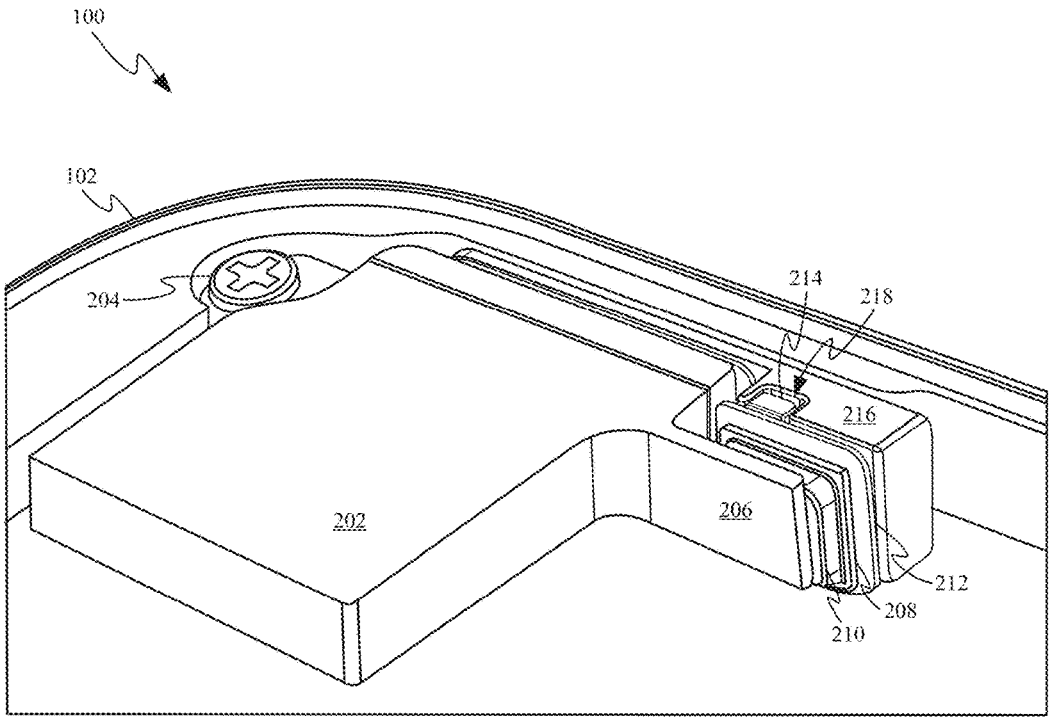
FIG. 2 shows an interior perspective view of one corner of the exemplary device depicted in FIG. 1.

FIG. 2 shows an internal perspective view of a portion of device housing 102 that defines audio openings 114 and 116 (not depicted). Speaker housing 202 is depicted being positioned proximate a sidewall of device housing 102. In some embodiments, speaker housing 202 can be secured to a device housing 102 by way of a fastener 204, although it should be noted that speaker housing 202 can be attached to device housing 102 in any number of ways. Speaker housing 202 includes a laterally protruding arm 206, which provides a mounting surface upon which microphone 208 can be mounted. Microphone 208 can be mounted to laterally protruding arm 206 by way of a foam adhesive layer 210 made up of a layer of foam and a layer of adhesive on opposing sides of the layer of foam. A compressibility of foam adhesive layer 210 can allow a certain amount of motion of microphone 208 with respect to laterally protruding arm 206 in the event of a drop event or other impact being applied to portable media device 100. Foam adhesive layer 210 can also attenuate any vibratory impulses being transmitted through speaker housing 202. Microphone 208 can be electrically coupled with other components within device housing 102 by way of flexible circuit 212. Microphone 208 can be surface mounted to one side of flexible circuit 212. An opposite side of flexible circuit 212 can then be adhesively coupled or soldered to a clip 214 that includes multiple arms for aligning microphone 208 and flexible circuit 212 with audio bracket 216. Each of the arms of clip 214 can engage a recess 218 defined by audio bracket 216. Each of recesses 218 can be substantially complementary to the arms of clip 214, so that alignment of the arms with the channels provides a predictable alignment of clip 214 with audio bracket 216. By engaging recesses 218 defined by audio bracket 216 the arms of clip 214 can provide precise alignment of an opening of microphone 208 and a channel defined by audio bracket 216. Audio bracket 216 is secured to an interior facing surface of a sidewall of device housing 102. In this way, microphone 208 is secured between laterally protruding arm 206 and audio bracket 216. Audio bracket 216 can take the form of a polymeric substrate defining multiple openings through which audio signals can be routed.

Figure 3A:
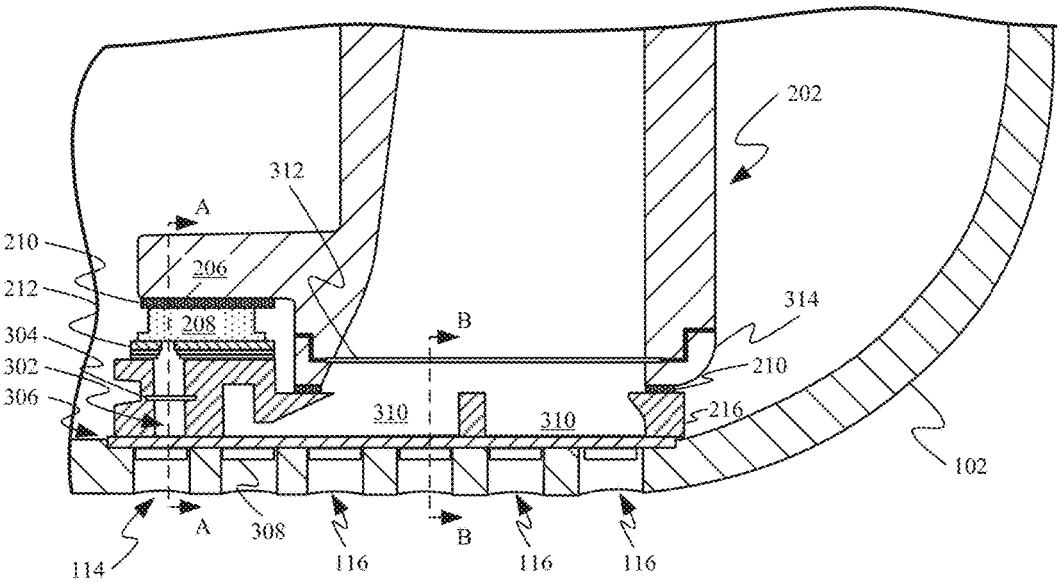
FIG. 3A shows a cross-sectional view of the portion of the exemplary device depicted in FIG. 2.

FIG. 3A shows a cross-sectional view of the corner of portable media device 100 shown in FIG. 2 and depicts how speaker housing 202 interacts with audio bracket 216 and microphone 208. In particular, the compression of microphone 208 between laterally protruding arm 206 and audio bracket 216 is depicted. An opening in flexible circuit 212 and channel 302 of audio bracket 216 allow audio to reach and be detected by microphone 208 through audio opening 114. In some embodiments, channel 302 represents an audio channel of about 1 mm in diameter. Acoustic mesh 304 extends across a central portion of channel 302 and operates to prevent small particles from passing through channel 302. Acoustic mesh 304 can be insert molded within audio bracket 216. In this way, peripheral portions of acoustic mesh 304 become permanently lodged within the portions of audio bracket 216 that define channel 302. As part of a production process, openings in acoustic mesh 304 can be inspected to ascertain whether the openings remained clear and well-suited for passing audio. This inspection process helps to remove bad parts that could have included incidences of partial or complete melting of acoustic mesh 304 or incidences of injection molding material clogging the openings of acoustic mesh 304.

FIG. 3A also shows cosmetic mesh assembly 306. Cosmetic mesh assembly 306 acts as an interface between audio bracket 216 and an interior surface of a sidewall of device housing 102. Cosmetic mesh assembly 306 includes a cosmetic mesh layer 308 having protrusions formed of a cosmetic mesh, which prevents the passage of relatively large objects into microphone channel 302 or any of speaker channels 310. It should be noted that in some embodiments cosmetic mesh can be darkened to make cosmetic mesh less visually noticeable. A size of the openings in cosmetic mesh layer 308 can be substantially larger than the openings of acoustic mesh 304. In addition to operating as a block for relatively larger foreign objects, cosmetic mesh can also be substantially more structurally robust than acoustic mesh 304. The structural integrity of this layer is important on account of there being no screening element in front of it, which allows all objects capable of passing through audio openings 114 and 116 to come in contact with it. In some embodiments, cosmetic mesh layer 308 can be constructed from a steel mesh having a strength suitable for deflecting small objects without being prone to puncture. In some embodiments, each of speaker channels 310 and microphone channel 302 can be made of multiple smaller audio channels or in some embodiments the depicted audio channels be combined into a unitary audio channel transmitting audio to and from all of the audio openings defined by device housing 102. Speaker housing 202 can also include acoustic mesh 312 that prevents small particulates from entering into speaker housing 202. Acoustic mesh 312 can be held in place between a forward portion 314 of speaker housing 202 and a remaining portion of speaker housing 202.

Figure 3B:
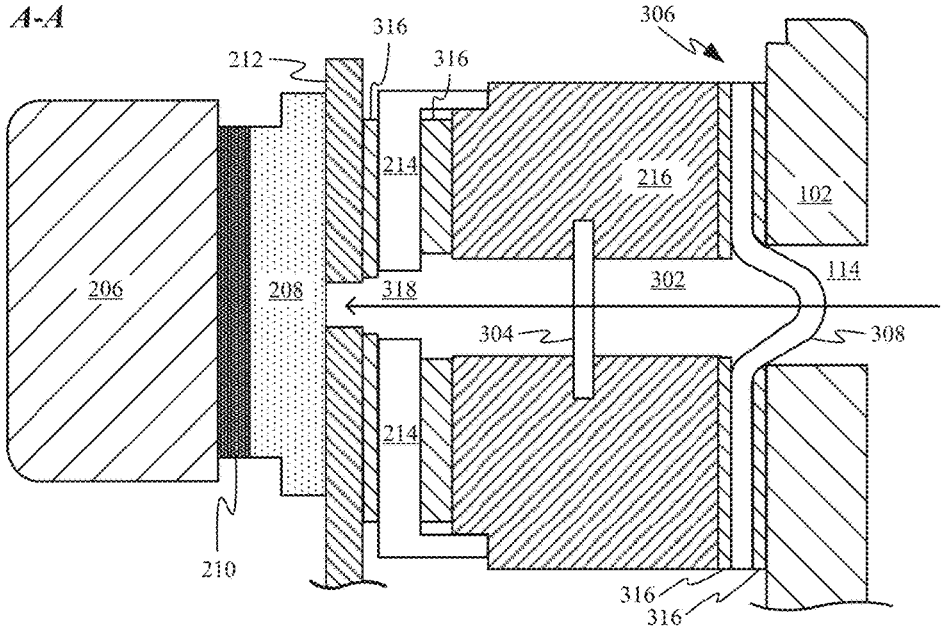
FIGS. 3B-3C show cross-sectional view of the exemplary device in accordance with section lines depicted in FIG. 3A.

FIG. 3B shows a cross-sectional view of portable media device in accordance with section line A-A of FIG. 3A. FIG. 3B depicts a path audio takes in reaching microphone 208. In particular, cosmetic mesh layer 308 is depicted. Cosmetic mesh layer 308 masks views of an internal portion of portable media device 100 and also prevents objects from passing through and into portable media device 100. Cosmetic mesh layer 308 can take the form of a layer of steel mesh that is adhered to device housing 102 and audio bracket 216 by double sided adhesive layers 316. In some embodiments, the steel mesh can be darkened to create the appearance of a dark audio opening. As depicted, cosmetic mesh layer 308 has openings well-suited for allowing audio signals to pass through. Once audio passes through cosmetic mesh layer 308 it enters audio channel 302. Audio channel 302 includes an acoustic mesh 304. Acoustic mesh 304 keeps particularly small particles such as dust from entering any farther into portable media device 100, while allowing acoustic waves to pass substantially unattenuated. As can be seen in this view, acoustic mesh 304 is embedded within material of audio bracket 216 that defines audio channel 302. Because acoustic mesh 304 is embedded within audio bracket 216 it doesn't require any adhesive layers to keep it in position. Clip 214 is shown being coupled with audio bracket 216 by adhesive layer 316. FIG. 3B also depicts how arms of clip 215 engage audio bracket 216, which causes an opening 318 defined by clip 214 to be precisely aligned with audio channel 302. Flexible circuit 212 is in turn coupled with clip 214 by another adhesive layer 316, although it should be noted that when clip 214 is formed from metal it can be soldered to flexible circuit 212. Flexible circuit 212 and adhesive layers 316 also include openings for accommodating the passage of audio to microphone 208. In this way, this stackup of audio components allows audio to enter portable media device and be detected by microphone 208.

Figure 3C:
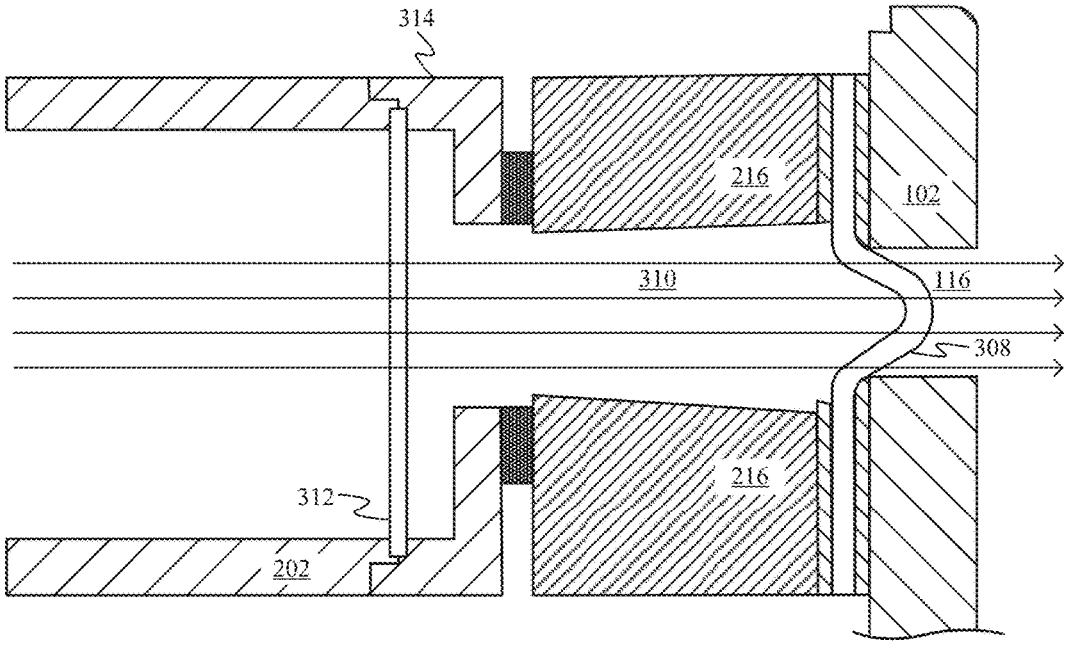

FIG. 3C shows a cross-sectional view of portable media device 100 in accordance with section line B-B of FIG. 3A. Speaker housing 202 is depicted which includes a forward portion 314 detachably coupled to speaker housing 202. In this way, acoustic mesh 312 can be secured between speaker housing 202 and forward portion 314. Once acoustic mesh 312 is installed within speaker housing 202, forward portion 314 can be permanently coupled with speaker housing 202 by, for example, an amount of adhesive. Acoustic mesh 312 allows audio in the form of acoustic waves to travel substantially unattenuated and then through an opening defined by forward portion 314. Forward portion 314 can be coupled with audio bracket 216 by another foam adhesive layer 210 as depicted. Foam adhesive layer 210 can define an opening through which the acoustic waves can travel. Once within audio channel 310, the audio can then pass through cosmetic mesh layer 308 and audio opening 116 to exit device housing 102. It should be noted that while microphone 208 is depicted being positioned external to speaker housing 202, in some embodiments, microphone 208 can be positioned within speaker housing 202.

Figure 4:
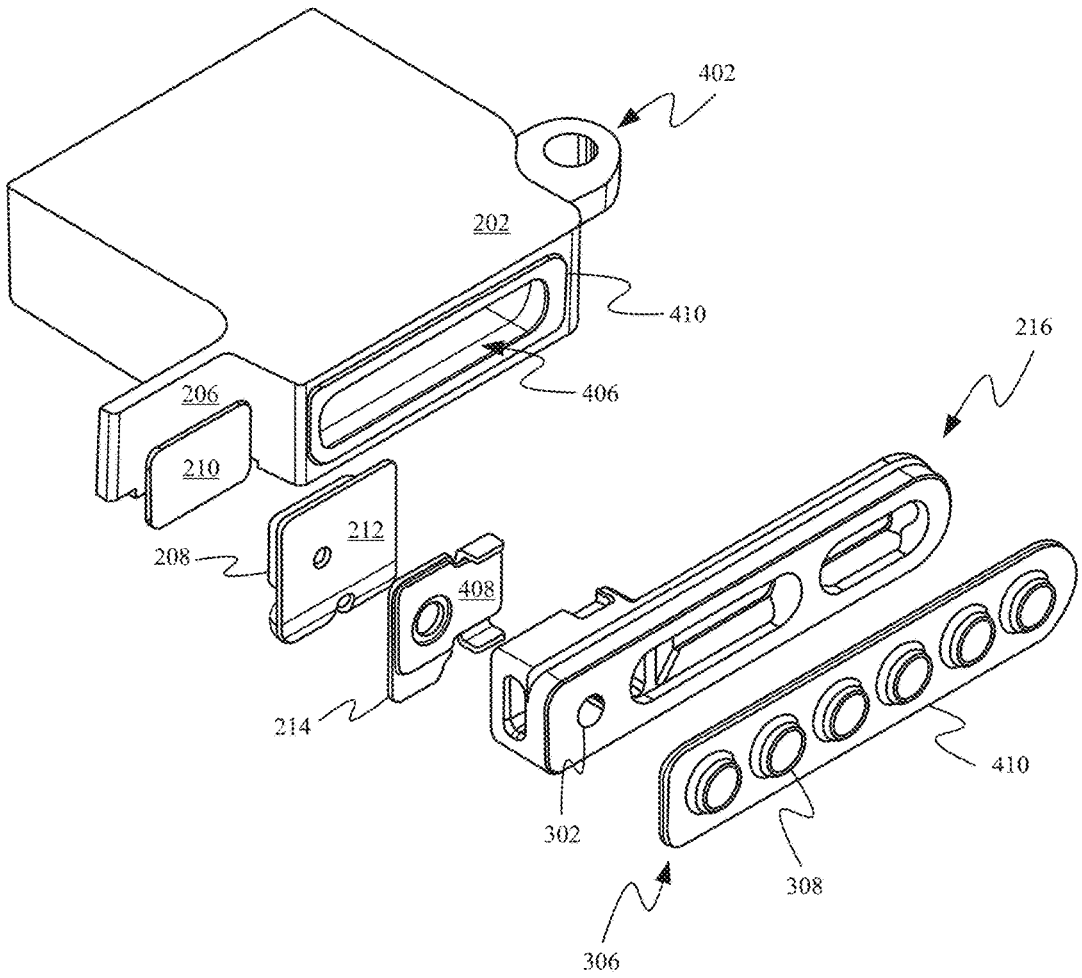
FIG. 4 shows an exploded view of audio bracket and parts associated with mounting a microphone adjacent to a speaker.

FIG. 4 shows an exploded view of speaker housing 202, audio bracket 216, cosmetic mesh assembly 306 and parts associated with mounting microphone 208. Speaker housing 202, in addition to having laterally offset arm 206 can optionally include a fastening feature 402. Fastening feature 402 defines a fastener opening configured to receive a fastener that secures speaker housing 202 to at least one portion of device housing 102. Speaker housing 202 also defines an opening 404 through which audio can exit speaker housing 202. Laterally offset arm 206 provides a flat surface that supports foam adhesive layer 210. Foam adhesive layer 210 has a shape and size that corresponds with a surface of microphone 208, which is in turn mounted to flexible circuit 212. It should be noted that only a small portion of flexible circuit 212 is shown for clarity sake and it should be understood that flexible circuit 212 can extend to other locations such as a main logic board and/or a power source of portable media device 100. In this way, flexible circuit 212 places microphone in communication with other components within device housing 102 and also provides power to microphone 802. Flexible circuit 212 also defines an opening through which audio can propagate to microphone 208. Clip 214 is also depicted and shows how clip 214 can include two arms. While not depicted in this view, it should be understood that audio bracket 216 also defines a channel for receiving the lower one of the arms. Once the arms of clip 214 are engaged with the channels of audio bracket 216 and clip 214 is compressed against audio bracket 216 a double sided adhesive layer 408 keeps clip 214 and audio bracket 216 from separating from each other again. Opening 406 can be surrounded by another foam adhesive layer 410. Foam adhesive layer 410 can be configured to form a tight seal with audio bracket 216 without obstructing any audio exiting speaker housing 202 through opening 406. FIG. 4 also depicts cosmetic mesh assembly 306. Portions of cosmetic mesh 308 disposed between the protruding portions can be coupled to adhesive layers 410 arranged across a surface of cosmetic mesh 308 that faces device housing 102 and across a surface of cosmetic mesh 308 that faces audio bracket 216. In this way, adhesive layers 410 effectively secure cosmetic mesh assembly 306 between audio bracket 216 and device housing 102.

Figure 5:
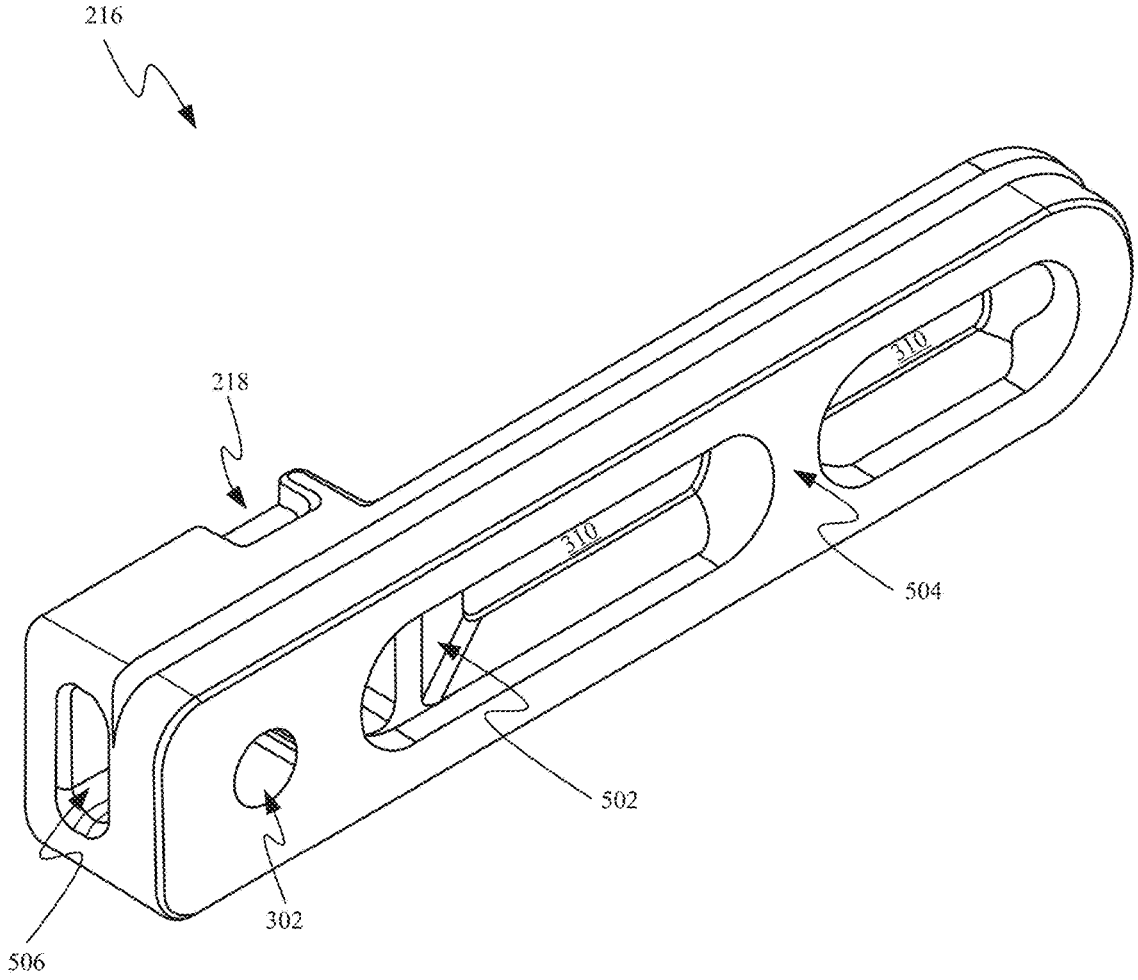
FIG. 5 shows a close up perspective view of the audio bracket depicted in FIG. 4.

FIG. 5 shows a close up view of audio bracket 216 and various internal features of audio bracket 216. This view of audio bracket 216 depicts a tapered geometry 502 of audio channel 310. By including tapering geometry within audio channel 310 as depicted, audio exiting audio bracket 216 can expand and use all of the audio openings defined by device housing 102. Structural support 504 can be formed between audio channels 310 to make audio bracket 216 more robust. For example, in some embodiments, the material used to form audio bracket 216 may not be robust enough to maintain a unitary opening that encompassed both audio channels 310. Audio bracket 216 can also include various recesses, along the lines of recess 506 to prevent sink conditions during formation of audio bracket 216. It should also be noted that while audio bracket 216 has been consistently discussed with regards to it being an injection molded part, in some embodiments, audio bracket 216 can be a part formed of other materials along the lines of metals and ceramics. While the use of another material could preclude the insert molding of the acoustic mesh, other functions and aspects of audio bracket 216 can remain unchanged. For example, in some embodiments, the portion of audio bracket 216 that defines audio channel 302 could be thinned to provide additional space for arranging audio mesh 304 behind audio bracket 216.

Figure 6A:
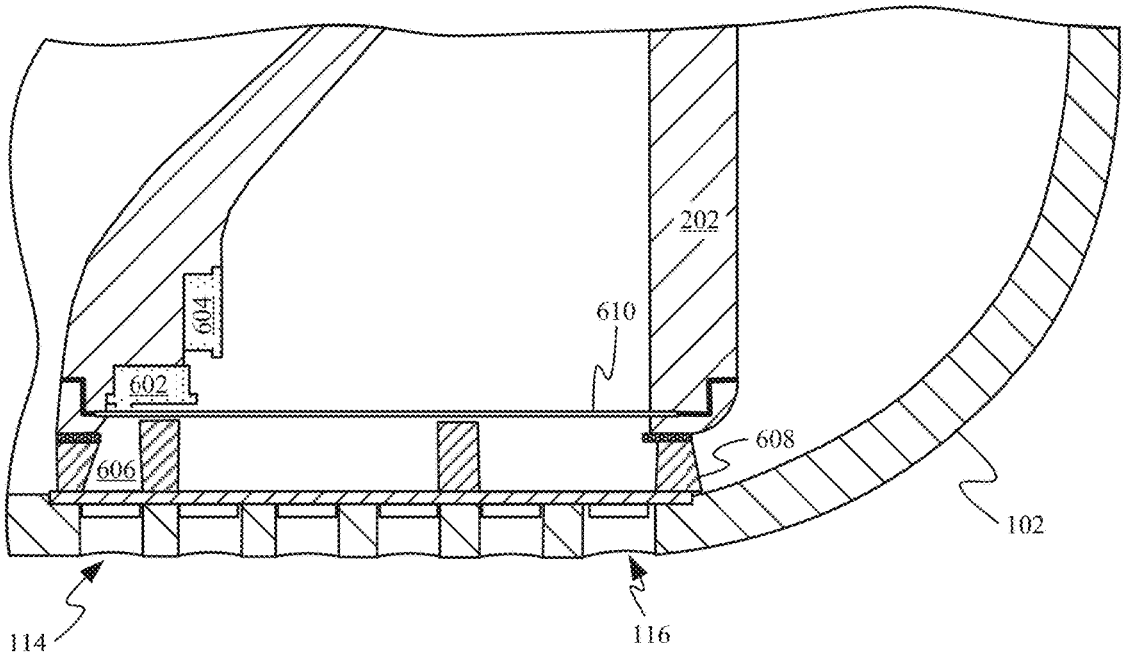
FIG. 6A shows an alternate embodiment in which multiple microphones are arranged within a speaker housing.

FIG. 6A shows an alternative embodiment in which microphones are placed within speaker housing 202 instead of being placed next to or adjacent speaker housing 202. Microphones 602 and 604 can be secured to interior surfaces of speaker housing 202. By offsetting microphones 602 to one side of speaker housing 202, microphones 602 and 604 can remain substantially out of the path of audio being emitted from speaker housing 202. Microphones 602 and 604 can be configured to provide an associated device with different types of information. For example, microphone 602 can be configured to receive externally generated audio through audio channel 606. A sensor opening in microphone 602 configured to receive audio can be aligned with audio channel 606 and a portion of audio bracket 608 that extends nearly up to or comes in direct contact with acoustic mesh 610 can help to isolate audio received by microphone 602 to audio transmitted through audio opening 114. In some embodiments, microphone 602 can be configured with a sensitivity and diaphragm well-suited for recording audio consistent with the spoken voice entering device housing 102 through audio opening 114. Microphone 604 can be tuned to a sensitivity and have a diaphragm consistent with a range of audio output emitted by speaker housing 202. In some embodiments, microphones 602 and 604 can concurrently detect audio. In other embodiments, only one of microphones 602 and 604 can be active at any given time. For example, microphone 602 can be activated and detecting audio when a phone call is in progress or when an application designed to record audio is placed in a recording state. In some embodiments, microphone 602 can be activated when a proximity sensor indicates an ear of a user is in close proximity to a particular surface of portable media device 100 before activating microphone 602 to listen for acoustic waves consistent with a voice of the user. In such an embodiment, microphone 602 can be tuned to record only audio coming from a direction consistent with audio being generated from the mouth of the user holding the phone to the ear. In some embodiments, when speaker housing 202 is emitting audio, microphone 602 can be deactivated and microphone 604 can be activated. It should be noted that while microphones 602 and 604 are depicted in a particular location within speaker housing 202 other locations are also possible. For example, microphones 602 and 604 could be positioned on opposing sides of housing 202 and/or be oriented in different directions.

Figure 6B:
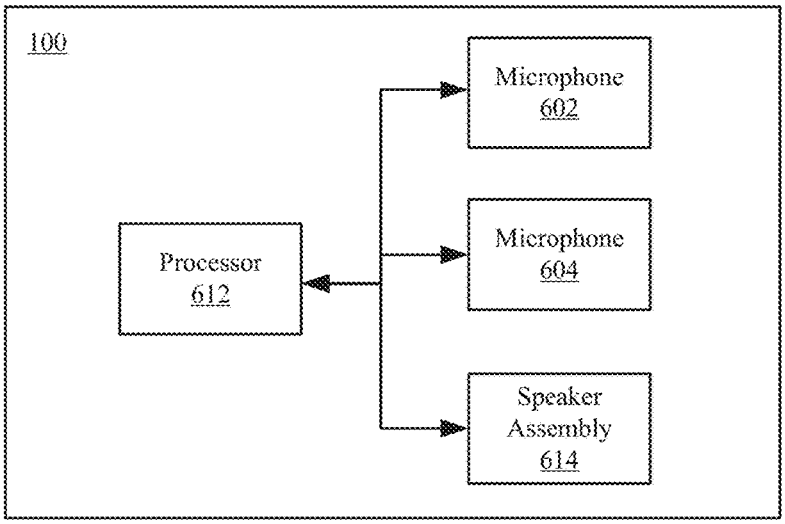
FIG. 6B shows a block diagram depicting communication between a processor and multiple audio devices.

FIG. 6B shows communication pathways between a processor 612, microphone 602, microphone 604 and speaker assembly 614 of portable media device 100. The described communications are fully compatible with the embodiment depicted and described in connection with FIG. 6A. Audio generated by speaker assembly 614 and emitted from speaker housing 202 can be detected by a microphone and characterized by processor 612 of portable media device 100. By monitoring the audio emitted from speaker housing 202 with microphone 604 the processor can determine when speaker assembly 614 begins to start producing distorted audio. This type of monitoring can be used to generate a closed loop control system capable of setting a dynamic threshold for audio output by speaker assembly 614. This can be particularly useful when an audio track being played back doesn't reach the volume normally reached by the speaker assembly due to improper audio encoding or any other number of reasons. In such a case, a user would be able to continuously raise the volume as long as speaker assembly 614 did not begin to distort. Once distortion was detected, the volume could be automatically lowered until distortion ceased to be detected. In this way, an amount of volume produced by speaker assembly 614 can be maximized without concern for causing distortion or damage to speaker assembly 614. In some embodiments, signals received from microphone 604 could be utilized to limit the audio volume below a preset threshold. For example, a user could choose to limit the output of a white noise application to below 30 dB. For a speaker with potentially dangerous amounts of audio output, another application could allow the audio to be limited below 85 dB where a user could be in danger of hearing loss. In some embodiments, microphone 604 could allow a user to set the output volume by an average number of decibels rather than by a preset volume level. In still other embodiments, a user could request the volume of an audio stream to be normalized so that any audio fell within a preselected volume range. Communication between microphone 602 and processor 612 can also produce beneficial outcomes. For example, inputs from both microphone 602 and other microphones situated around portable media device 100 can be used to perform beam forming which helps to filter out audio being received from undesirable sources. For example, the beam forming could assist in receiving audio only from a user of portable media device 100 while filtering interference such as ambient noises out.

Figure 7:
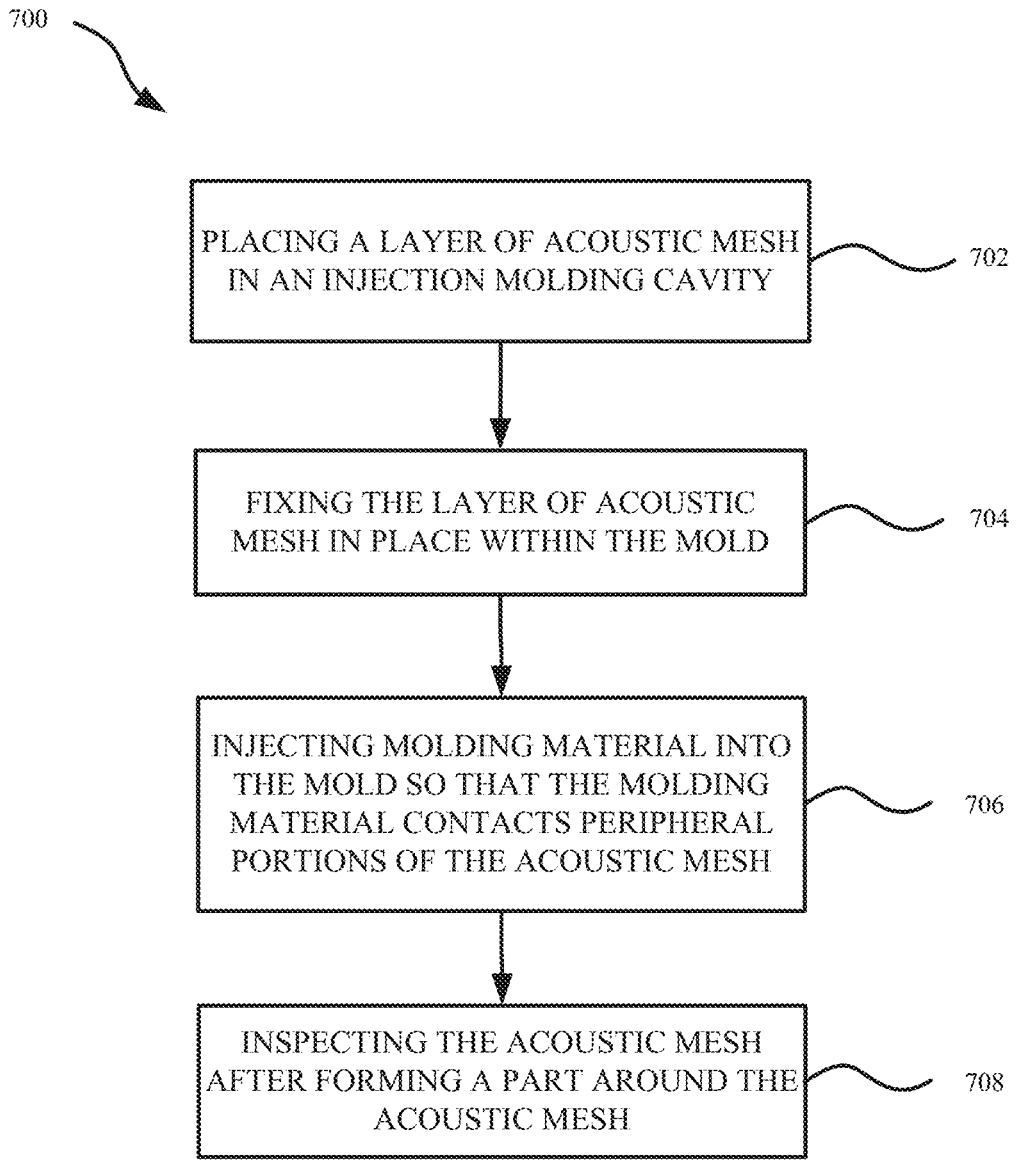
FIG. 7 shows a flow chart depicting a method for embedding an acoustic mesh within an audio bracket.

FIG. 7 shows a flow chart illustrating a method 700 for insert molding a layer of acoustic mesh within an audio bracket. At block 702, a layer of acoustic mesh is picked up by a pick and place with a suction head that arranges the acoustic mesh within an insert molding cavity. The layer of acoustic mesh can have a pitch and opening suitable for allowing acoustic waves to pass through substantially unattenuated while stopping foreign debris along the lines of dust particles from entering into and inhibiting operation of internal components of a portable media device to which the audio bracket is attached. At block 704, the location in which the layer of acoustic mesh includes a holder for holding the layer of acoustic mesh in place within the cavity. For example, the injection molding cavity can include its own suction system designed to keep the acoustic mesh in place during an injection molding operation. Alternatively or additionally, the layer of acoustic mesh can be compressed between two rods that define an audio channel during the insert molding operation. In some embodiments, the audio channel formed by the rods can have a narrow diameter (e.g., about 0.8 mm). At block 706, injection molding material is injected into the cavity and engages and comingles with a periphery of the layer of acoustic mesh. The injection molding material can take many forms including for example plastics/polymers, glass fiber, silicone and metals. After the rods are removed and the resulting acoustic bracket is removed from the cavity, only the portion of the layer of acoustic mesh extending across the acoustic channel remains exposed, while the portion of the acoustic mesh embedded within the molded audio bracket is retained firmly in place by the molding material. At block 708, subsequent to the audio bracket cooling an inspection can be conducted to verify the openings in the acoustic mesh remain open. In some embodiments, a camera can be used to carry out the inspection, which can take the form of a CCD (charge-coupled device) that can be placed at one opening of the audio channel while a light can be directed through an opening at an opposite end of the audio channel. In this way, the openings in the acoustic mesh can be counted and characterized by the CCD. In situations where too many of the openings are filled with injection molding material or melted together, the part can be rejected.

The various aspects, embodiments, implementations or features of the described embodiments can be used separately or in any combination. Various aspects of the described embodiments can be implemented by software, hardware or a combination of hardware and software.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A portable media device, comprising:

a device housing including a wall defining multiple audio openings;

an audio bracket comprising a first end and a second end opposite the first end, the audio bracket defining multiple audio channels extending from the first end to the second ends of the audio bracket, the first end being coupled with a portion of the wall that defines the audio openings;

a speaker housing defining an opening configured to emit audio and comprising a laterally protruding arm, wherein a portion of the speaker housing defining the opening is coupled with the second end of the audio bracket so that audio emitted by the speaker housing is transmitted through an audio channel and then out of the device housing by one of the audio openings; and a microphone coupled with the laterally protruding arm and the second end of the audio bracket, the microphone being positioned to receive audio entering the device housing through one of the audio openings by way of one of the audio channels.

2. The portable media device as recited in claim 1, wherein the audio bracket further comprises an acoustic mesh embedded within the audio bracket and extending across one of the audio channels.

3. The portable media device as recited in claim 2, further comprising:

a cosmetic mesh positioned between the first end of the audio bracket and the portion of the wall that defines the audio openings, the cosmetic mesh having a mesh pattern defining openings substantially larger than the openings defined by the acoustic mesh.

4. The portable media device as recited in claim 3, wherein the cosmetic mesh comprises protrusions that extend into the audio openings defined by the device housing.

5. The portable media device as recited in claim 1, further comprising:

an alignment clip coupled with the microphone and engaged with recesses defined by the audio bracket that align the microphone with at least one of the audio channels defined by the audio bracket.

6. The portable media device as recited in claim 5, further comprising:

a flexible circuit, comprising a first surface electrically and mechanically coupled with the microphone, a second surface opposite the first surface and mechanically coupled with the alignment clip, wherein the flexible circuit defines an opening that is aligned with the audio channel of the audio bracket.

7. The portable media device as recited in claim 5, further comprising:

a processor disposed within the device housing, wherein the flexible circuit electrically couples the microphone with the processor.

8. The portable media device as recited in claim 1, further comprising a foam adhesive layer that mechanically couples the microphone to the laterally protruding arm of the speaker housing and reduces the transmission of vibration between the microphone and the speaker housing.

9. A portable electronic device, comprising:

a device housing including a wall defining multiple audio openings;

a speaker housing disposed within the device housing and defining an opening configured to emit audio, the speaker housing comprising a laterally protruding arm;

an audio bracket defining audio channels through which the speaker assembly transmits audio, the audio bracket comprising a first side coupled to a portion of the speaker housing that defines the opening and a second side coupled to the wall, one or more of the audio channels being configured to transmit audio emitted from the opening defined by the speaker housing to the audio openings defined by the wall; and a microphone coupled with the laterally protruding arm and the first side of the audio bracket, the microphone being configured to receive audio through one or more of the audio channels.

10. The audio assembly as recited in claim 9, further comprising a flexible circuit comprising a first surface and a second surface opposite the first surface, the first surface being electrically and mechanically coupled to the microphone.

11. The audio assembly as recited in claim 10, further comprising:

an alignment clip including multiple arms that couple the alignment clip with the audio bracket by engaging alignment recesses defined by the audio bracket, wherein the alignment clip is mechanically coupled to the second surface of the flexible circuit.

12. The audio assembly as recited in claim 10, wherein at least a portion of the audio received by the microphone passes through an opening defined by the flexible circuit.

13. The audio assembly as recited in claim 9, further comprising an acoustic mesh including a peripheral portion embedded within the audio bracket and a central portion extending across one of the audio channels defined by the audio bracket.

14. The audio assembly as recited in claim 13, wherein the acoustic mesh extends across the audio channel aligned with the microphone.

* * * * *